US005338284A

United States Patent [19]

Knelson

[11] Patent Number: 5,338,284

[45] Date of Patent: Aug. 16, 1994

[54] CENTRIFUGAL SEPARATOR WITH SUBSTANTIALLY CONTINUOUS DISCHARGE OF FINES

[76] Inventor: Benjamin Knelson, 20321-86th Avenue, R.R. #11, Langley, British Columbia, Canada, V3A 6Y3

[21] Appl. No.: 922,338

[22] Filed: Jul. 30, 1992

[51] Int. Cl.[5] ..... B04B 11/00

[52] U.S. Cl. ..... 494/28; 494/29; 494/56; 494/80

[58] Field of Search ..... 494/27-31, 494/36, 43, 45, 56, 57, 60, 65, 80; 210/360.1, 360.2, 369, 380.1, 381, 382, 781

[56] References Cited

U.S. PATENT DOCUMENTS

| | | | |
|---|---|---|---|
| 957,478 | 5/1910 | Simpson . | |
| 1,238,846 | 11/1918 | Mark et al. | 494/60 |
| 1,473,421 | 11/1923 | Eccleston . | |
| 1,557,672 | 10/1925 | Doerner . | |
| 1,594,501 | 8/1926 | Eccleston . | |
| 1,882,389 | 10/1932 | Maclsaac . | |
| 2,179,807 | 11/1939 | Asmussen | 494/45 X |
| 2,272,675 | 2/1942 | Knudsen | 494/43 X |
| 2,688,437 | 9/1954 | Monnet . | |
| 2,723,799 | 11/1959 | Sharples . | |
| 3,152,074 | 10/1964 | Fontein et al. . | |
| 3,192,149 | 6/1965 | Keith, Jr. . | |
| 3,797,736 | 3/1974 | Günnewig . | |
| 4,361,480 | 11/1982 | Corbus et al. | 494/60 X |
| 4,432,748 | 2/1984 | Novoselac et al. . | |
| 4,608,040 | 8/1986 | Knelson . | |
| 4,776,833 | 10/1988 | Knelson . | |
| 4,846,781 | 7/1989 | Knelson | 494/27 |
| 4,966,576 | 10/1990 | Schultz et al. . | |
| 4,983,156 | 1/1991 | Knelson | 494/28 |

FOREIGN PATENT DOCUMENTS

| | | | |
|---|---|---|---|
| 2205535 | 4/1935 | Australia | 494/27 |
| 2180589 | 11/1973 | France . | |
| 2133722 | 8/1984 | United Kingdom . | |
| 93/13864 | 7/1993 | World Int. Prop. O. . | |

*Primary Examiner*—David A. Scherbel
*Assistant Examiner*—Charles Cooley
*Attorney, Agent, or Firm*—Adrian D. Battison; Stanley G. Ade; Murray E. Thrift

[57] ABSTRACT

A centrifugal separator with substantially continuous discharge of the concentrate comprises a centrifuge drum with axially spaced rings projecting inwardly from the peripheral wall of the drum. The material between the rings is fluidized by injection of water. Each channel between the rings has a number of exit openings at the base of the channel for discharge of the concentrate. Each exit opening includes a pinch valve to restrict the discharge to predetermined time periods. Each exit includes injection openings around the exit for injecting water to replace the material discharged to maintain the fluidization between the channel.

19 Claims, 4 Drawing Sheets

CENTRIFUGAL SEPARATOR WITH SUBSTANTIALLY CONTINUOUS DISCHARGE OF FINES

BACKGROUND OF THE INVENTION

This invention relates to a centrifugal separator of the type which can be used to extract heavier materials from a slurry containing the material mixed with other materials.

My published U.S. Pat. Nos. 4,776,833 and 4,608,040 disclose a device of this type which comprises a centrifugal bowl having a base and a peripheral wall surrounding an axis passing through the base and generally upstanding from the base to an open mouth, a plurality or axially spaced inwardly projecting rings mounted on an inner surface of the peripheral wall and a plurality of openings extending through the peripheral wall from the outer surface to the inner surface thereof, the openings being arranged between each ring and the next adjacent ring and in spaced relation around the peripheral wall, means mounting the bowl for rotation about the axis, means for feeding the materials into the bowl so that during rotation of the bowl they flow over the peripheral wall for discharge from the open mouth and means for applying fluid to the outer surface of the bowl so as to pass through the openings and fluidize the materials between the rings, the openings passing through the peripheral wall in a direction inclined to an axial plane passing therethrough so as to tend to direct the fluid around the peripheral wall.

This device has been found to operate very satisfactorily and in a considerably improved manner relative to prior art devices. However it is a batch discharge device in that the material separated between the rings remains between the rings and after a period of time it is necessary to halt operation of the bowl and to wash out the remaining material for collection and final separation to retrieve the gold or other heavier material.

There has long been a need and a desire for a separator of this general type which operates in a continual mode, that is the mixture is fed in at one point and two exit streams are retrieved, one including the heavier materials and the other including the lighter materials.

This requirement has become particularly important when a separator of this type is employed in other industries such as the coal industry for separation prior to combustion of the heavier sulfites from the coal to reduce emission of sulfur dioxide to atmosphere during combustion and such as the steel industry for separation of steel particles from soot. In these cases, the amount of heavy material can make the process inefficient due to the stops necessary for batch discharge.

The present invention provides an improvement over my above described device which allows the separator to discharge in a continuous mode. The centrifugal separator of the present invention therefore provides an arrangement for continuous or substantially continuous separation of heavier materials. The apparatus includes a bowl having an inner surface which has separating means on the inner surface for separating the heavier material from the lighter materials which pass over the wall of the bowl to an open mouth for discharge. The separating means preferably comprises a plurality of axially spaced rings mounted on the wall and projecting inwardly toward the axis of the bowl and defining between each ring and the next ring an annular recess within the heavier materials are collected. At the base of each recess is provided a plurality of angularly spaced discharge openings each of which extend only over a part of the periphery of the bowl so that the majority of the periphery is free from the openings.

In order that the material can escape through the openings, the materials in the recess are fluidized so that they can rotate around the bowl to the next adjacent discharge opening.

This fluidization is effected by the provision of injection holes which are inclined around the bowl and also by optional second injection openings which are arranged around each discharge opening to inject fluid into the area radially inward of the opening. These fluidization jets cooperate to maintain the material within the recess fluidized to ensure that the material can pass to the discharge opening without forming pockets which discharge an stationary material between the discharge openings.

A valve is provided which controls the exit of material through an orifice defining the opening adjacent the surface of the bowl. The chamber diverges outwardly from the orifice to the valve with the valve having a larger diameter or transverse dimension than those dimensions than the orifice so that a slug of material between the orifice and the valve escape without possibility of hang up.

Embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
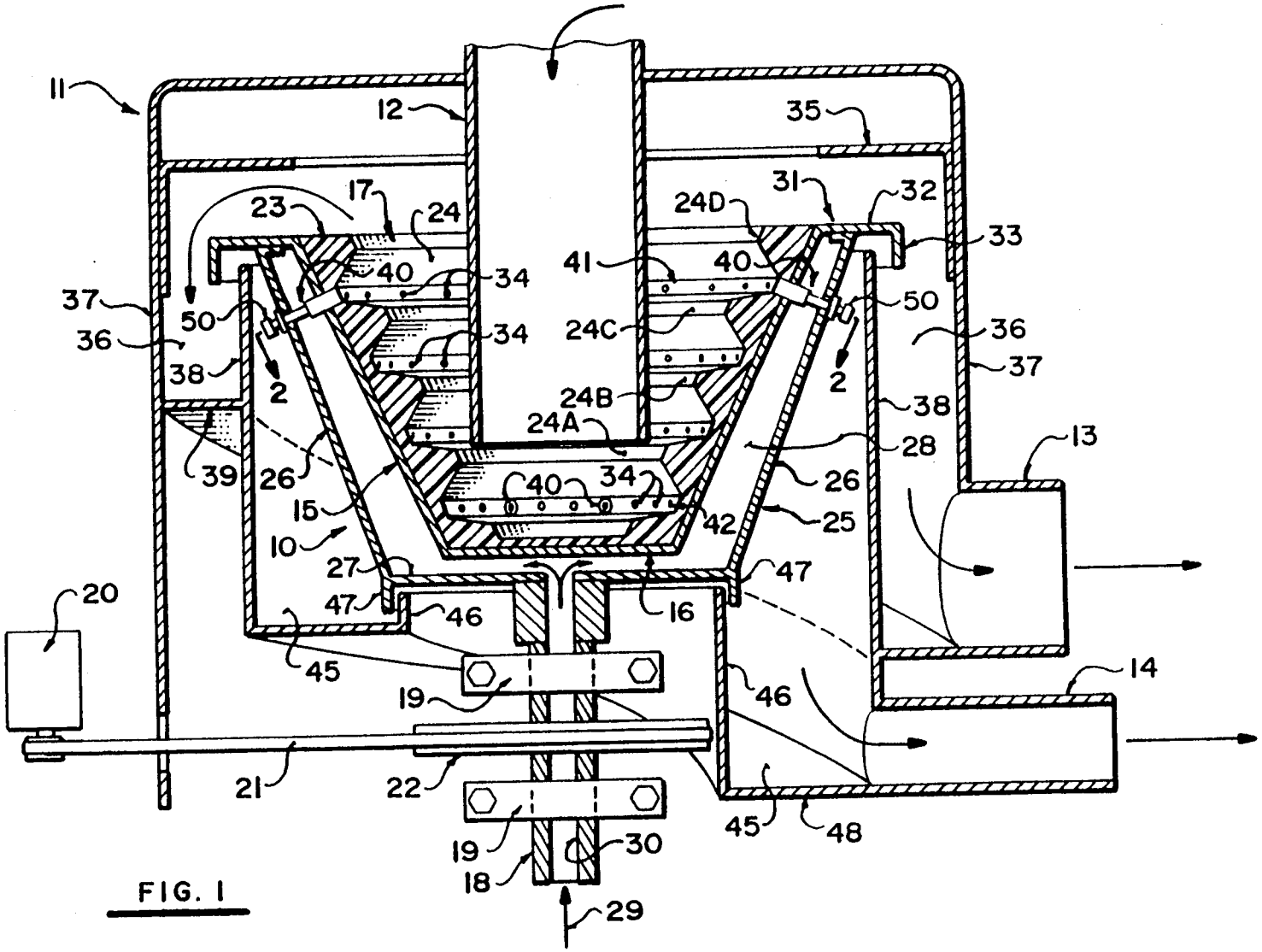
FIG. 1 is a cross sectional view through a centrifugal separator according to a first embodiment of the present invention.

A centrifugal separator comprises a bowl generally indicated at 10 mounted within a housing 11. The housing includes a feed duct 12 through which an incoming feed material is supplied for separation into components of different density or weight. The housing further includes two outlets including a first discharge outlet 13 for lighter materials and a second discharge outlet 14 for heavier materials subsequent to the separation of the materials within the bowl.

The bowl 10 includes a peripheral wall 15, a base 16 and an open mouth 17. The peripheral wall 15 surrounds a vertical axis of the bowl around which the bowl can be rotated by a shaft 18 mounted on bearings 19 and driven by a motor 20, belt 21 and pulley 22.

The base 16 is substantially flat and the peripheral wall 15 is frusto conical so as to taper outwardly and upwardly from the base to the open mouth 17. The base and peripheral wall are formed of a suitable supporting metal. On the inside surface of the peripheral wall is cast a polyurethane liner 23 which has an outer surface bonded to the inner surface of the peripheral wall 15 and an inner surface 24 which is shaped to define a plurality of grooves and inwardly projecting rings arranged in axially spaced locations along the height of the peripheral wall.

The construction of the bowl and the inner liner is thus substantially similar to that disclosed in my previous U.S. Pat. Nos. 4,776,833 and 4,608,040 the details of which are incorporated herein by reference.

Thus the inner surface of the liner is molded to form four inwardly projecting members each in the form of an annular ring 24A, 24B, 24C and 24D. Between each of the rings and the next adjacent ring and between the lowermost ring 24A and the base is provided a respective one of a plurality of V-shaped recesses or grooves. The side walls of the groove at an angle of the order of 15° to 30° and the flat base of the groove having a width of the order of 0.25 to 0.50 inches.

The apex of each of the rings is arranged at a distance from the peripheral wall substantially equal to each of the other apexes so that the apexes are aligned and substantially parallel to the peripheral wall. The thickness of the material at the base of each of the grooves is again substantially constant and relatively thin so that the base of the groove is closely adjacent the peripheral wall leaving just enough material to provide support for the structure.

The base and peripheral wall of the bowl are mounted within an outer jacket 25 including a peripheral wall 26 generally parallel to the peripheral wall 15 and a base 27 generally parallel to the base 16 of the inner bowl. Thus there is defined between the jacket and the inner bowl a substantially cylindrical open chamber 28 for receiving a pressurized fluid generally water. The water is supplied through a duct 29 passing through an opening 30 in the shaft 18 and opening at the centre of the base 27.

The upper edge of the peripheral wall 26 is connected to the upper edge of the peripheral wall 15 by a flange arrangement 31 which seals the chamber 28 and includes an outwardly projecting flange portion 32 extending beyond the peripheral wall 26 and then down turn flange portion 33 extending vertically downwardly at a peripheral extending lip around the full extent of the flange 32.

Figure 2:
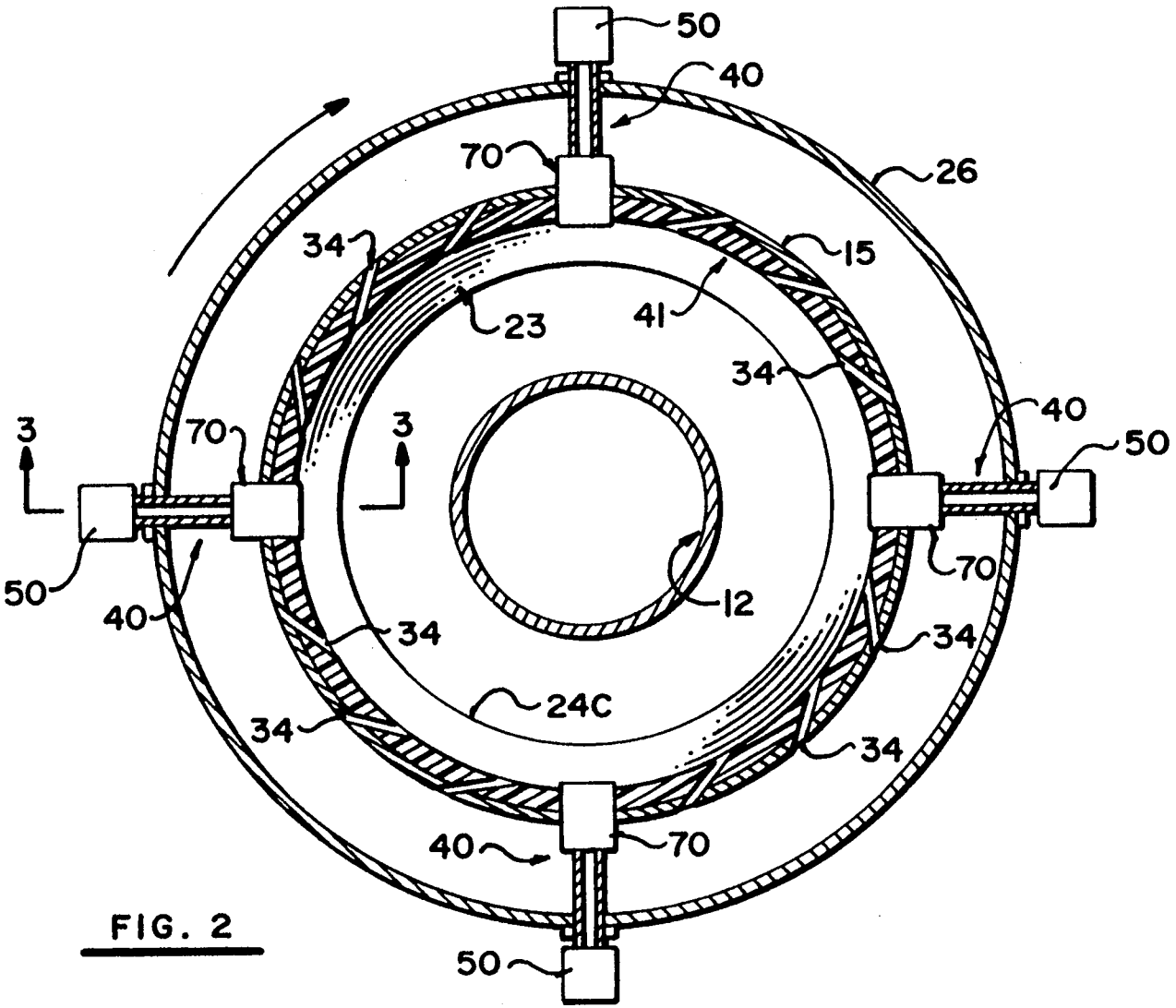
FIG. 2 is a cross sectional view along the lines 2—2 of FIG. 1.
Figure 3:
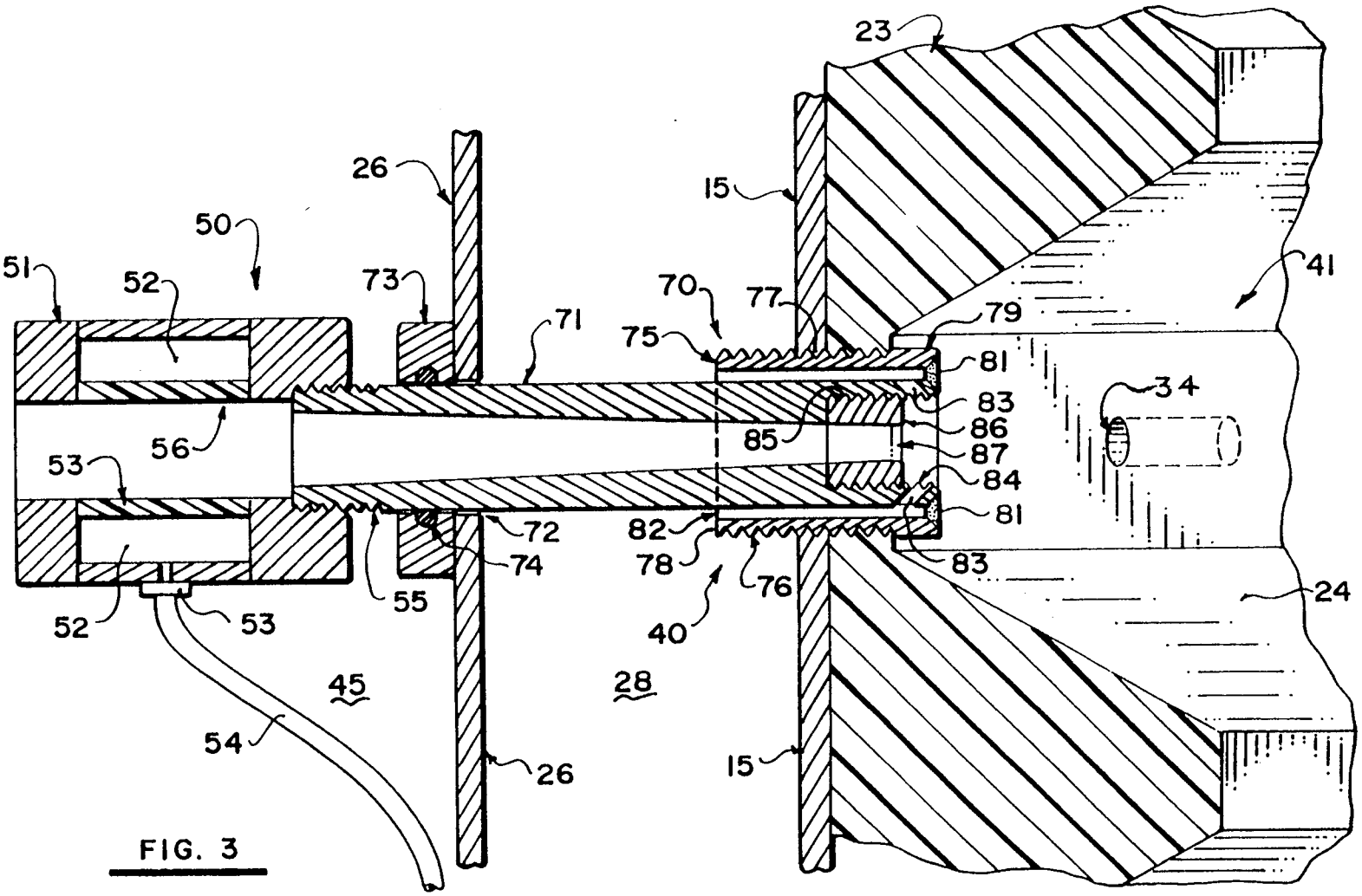
FIG. 3 is a cross sectional view along the lines 3—3 of FIG. 3 on an enlarged scale.

Each of the grooves has the flat base as previously described within which is defined a plurality of holes 34 each of which extends through the peripheral wall 15 and through the material 24 so as to break out at the base of each of the grooves. The holes are arranged in spaced relation angularly around each of the grooves. The holes are arranged as tangentially as possible to the peripheral wall as best shown in FIGS. 2 and 3 by punching a portion of the peripheral wall outwardly and then drilling the hole 34 through an end face of the punched portion and through the material 24 to break out on the inside surface of the material 24. This arrangement is as previously described in my U.S. Pat. Nos. 4,776,833 and 4,608,040.

Within the housing 11 there is provided a pair of guide elements 35 which are positioned adjacent the open mouth so that material escaping upwardly and outwardly from the open mouth is turned by the guide elements from the initial horizontal direction downwardly into a launder 36 provided within the housing, with the launder 36 communicating with the first outlet duct 13 for collecting the material discharged from the open mouth. The launder 36 is defined by a cylindrical wall 37 of the housing and a coaxial cylindrical wall 38 provided inside the housing and defining therebetween an annular channel forming the launder 36. A base 39 of the annular channel extends helically downwardly from an uppermost part on the one side opposite the outlet 13 downwardly towards the outlet 13 at the bottom of the housing. The flange 33 is turned downwardly on an outside surface of the cylindrical wall 38 so as to direct the material into the launder and prevent back-up into the area around the bowl.

A similar arrangement is substantially as previously described in my earlier patents in that the material is fed into the bowl at the base along the axis of the bowl through the duct 12 and dropped to the bottom of the bowl at which point it is accelerated by the rotating bowl to a high centrifugal force causing it to spread outwardly from the base onto the peripheral wall so that the material then flows across the peripheral wall and out through the open mouth. Heavier materials are preferentially collected between the rings within the V-shaped grooves. The fluidization of the material within the V-shaped grooves provided by the injection of water through the openings 34 assists in the separation.

The rings are preferably annular so that each groove is axially separated from the next adjacent groove. However an alternative arrangement may include a helical type groove so that the rings do not constitute actually rings but are instead formed by helical screw thread shaped projecting element on the inside surface.

The V-shaped grooves have a depth at least 5 inches so that in one practical example, the diameter of the peripheral wall at the mouth is of the order of 26 inches and the diameter of the apex of the adjacent ring is of the order of 16 inches. The base is of order of one half the width of the open mouth. This defines an angle of taper of the order of 15° which is certainly less than 45° used in previous arrangements. The angle of the peripheral wall to the axis is significantly increased relative to previous devices and is preferably greater than 25° and more preferably in the range of 35° to 50°. In this way the radius of one groove is significantly greater than the radius of the previous groove so as the material moves axially up the height of the wall it is required to accelerate in an angular direction. In this way the material at or in each groove is being accelerated by the frictional contact of the material with the inside surface of the groove. Thus there is relative movement between the material and the inside surface of the groove tending to cause the material to move around the bowl in a direction opposite to the direction of rotation of the bowl. The direction of injection of water is also arranged to supplement this tendency to move so the water is injected also in a direction opposite to the direction of rotation of the bowl. The number of rings is as shown preferably four rings but is preferably in the range four to five since it has been found that with this number of rings the material in each groove is accelerated and thus provides this relative movement. Whereas with a larger number of rings, the material reaches the angular velocity of the bowl so that no relative movement occurs.

The material is discharged from the bowl from the base of each of the rings by a plurality of outlet elements 40 which are attached to the peripheral wall 15 and extend therefrom through a duct which projects through the peripheral wall 26 to an open mouth facing substantially radially outwardly from the bowl.

Each of the grooves has provided therein a plurality of the outlet elements 40. In the arrangement illustrated, the uppermost groove indicated at 41 has four of the outlet members 40 provided thereon and arranged at 90° spacing around the bowl. In FIG. 1 is shown the lowermost groove indicated at 42 which again has four of the outlet elements 40 associated therewith at angularly spaced locations around the periphery of the bowl. Although four such elements are shown, it may in some cases be desirable that the amount of material extracted from the lowermost groove 42 is significantly greater than that extracted from the uppermost groove 41 and from the other of the upper grooves. In order to achieve this, the number of the outlet elements may be increased and/or the dimensions of the outlet members are discussed hereinafter may be increased to provide an increased total area of outlet for the material from the groove 42. The outlet elements 40 as shown are staggered so that the elements of one ring are angularly offset from the elements of the next ring.

All of the outlet elements thus project through the peripheral wall 26 into a second launder area 45 defined between the cylindrical wall 38 and an inner cylindrical wall 46 defining the annular launder area 45 therebetween. Flange 47 at the bottom of the peripheral wall cooperates with the top edge of the wall 46 to retain the material within the launder so that it can flow downwardly over a base helical wall 48 to the outlet 14 separate from the outlet 13.

Depending upon the materials to be separated, the lighter materials at the outlet 13 may be collected for use while the heavier material is discarded or the heavier materials of the outlet 14 may be collected for use with the lighter material discarded or both may be used depending upon their characteristics. In one example, the device is used for the separation of sulfites from coal so that the heavier sulfites in the outlet duct 14 will be discarded and the lighter coal material carded in a slurry of water can be used from the outlet 13.

In an alternative use, steel particles can be extracted from soot from a steel smelting operation in which case both outlet streams may be useable for different end uses.

In a further example, heavy metals can be cleaned from soil in an environmental clean-up with the clean soil being returned to use and a smaller quantity of soil and contaminants either used or discarded in an environmentally sound manner.

Figure 4:
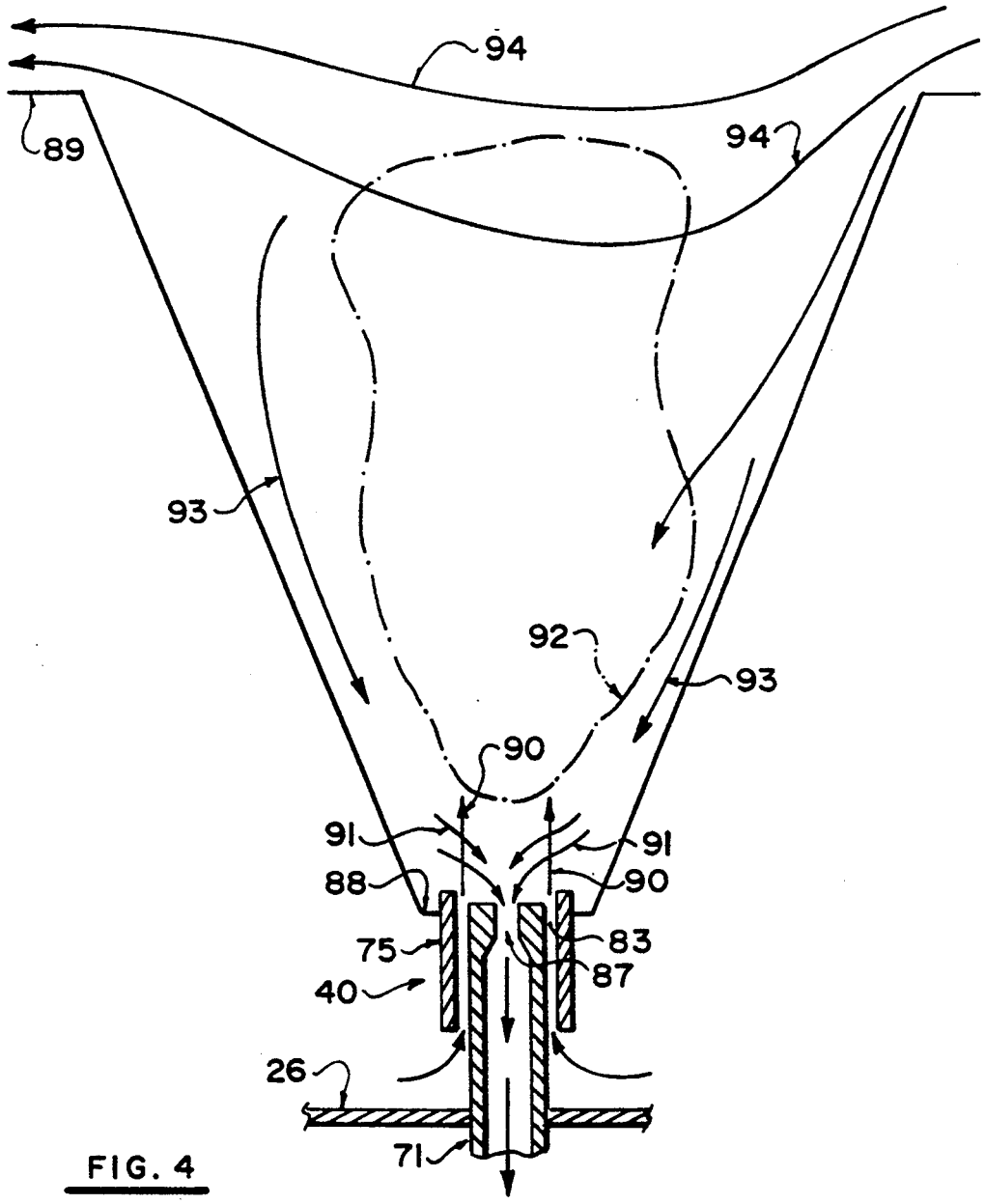
FIG. 4 is a cross sectional view similar to that of FIG. 3 showing schematically the material flow within a recess.

Turning now to FIGS. 3 and 4, the construction and operation of the outlet 40 is shown in detail. In FIG. 3 the outlet member 40 is shown in cross section and includes an outlet body 70 and a tube 71 for communicating the outlet material through the chamber 28 through an opening in the wall 26 and into the launder 45. The opening in the wall 26 is indicated at 72 and is closed by a sealing member 73 fastened to the outside surface of the wall 26 and carrying a sealing ring 74 cooperating with an outside surface of the tube 71. The outlet body 70 includes an outer sleeve 75 which has a male screw thread 76 on an outside surface for engagement into a female screw thread 77 provided on an opening formed through the wall 15 of the bowl and through the material forming the grooves at the base of the groove 41. The male screw thread 76 extends along the sleeve from an outer end 78 to a cap portion 79 at the inner end of the sleeve so that the sleeve can be screwed into the opening 77 down to the cap portion leaving the cap portion extending upwardly into the interior of the groove 41.

An end face 80 of the cap portion is welded to an inner end of the tube 71 at a weld line 81 thus defining an annular channel 82 between the outer surface of the tube 71 and the inner surface of the sleeve 75. This allows water from the chamber 28 to enter into the open end of the annular channel at the outer end 78 of the sleeve to pass along the annular channel toward the cap portion 79.

At the cap portion 79 is formed a plurality of drilled openings 83 which communicate the water from the annular channel 82 longitudinally of the axis toward a position above the inner end of the tube 71. The number of the openings 83 can be varied in accordance with requirements but in a preferred arrangement there are four such openings arranged equidistantly spaced around the axis of the tube 71. In the embodiment shown in FIG. 3, the openings 83 extend through the wall of the tube 71 at an angle to the axis so as to inject water inwardly and longitudinally of the axis. In the embodiment shown in FIGS. 4 and 5, the openings are formed through the weld line 81 so as to inject the water substantially parallel to the axis of the tube 71.

The inside surface of the tube 71 at the inner end of the tube carries a female screw thread 84 which extends from the inner end inwardly to a position part way along the tube. The female screw thread 84 receives a male screw thread 85 provided on an orifice member 86 which defines a diameter of an outlet orifice 87 through which material can pass from the base of the groove into the tube 71. The size of the orifice 87 can be varied simply by replacing the orifice member which can be unscrewed and readily replaced.

The operation of the outlet member 40 is shown in more detail in FIG. 4 in which the outlet member is shown more schematically but includes the outer sleeve 75, the tube 71, the inlet jets 83 and the outlet orifice 87.

It will be noted that the depth of the recess or groove within which the material is collected is significantly greater than that used conventionally in a centrifuge bowl of the type previously manufactured under the design of the aforementioned U.S. patents of the present inventor. Thus the depth of the groove from a base 88 of the groove to an apex 89 of the groove is preferably at least five inches so as to provide a relatively large amount of material in which the separation between the heavier and lighter materials occurs.

Preferably the diameter of the orifice 87 lies in the range $\frac{1}{8}$ inch to $\frac{3}{8}$ inch and preferably of the order of 0.25 inch. This orifice size is relatively small in comparison with the diameter of a practical example of bowl which might be of the order of twenty six inches but in view of the very large gravitational forces involved in high speed rotation, the amount of material expelled through the small orifice is relatively large. In addition the material expelled is mostly dry since the heavier solid materials are expelled preferentially to the water content. The orifice therefore constitutes a "sink" through which the material is discharging rapidly radially outwardly. This movement in the radial direction therefore tends to form a "dry" or stationary spot in the material within the ring which then prevents the required rotation of the material angularly around the bowl. Once the angular movement of the material is halted, the heavier materials remain trapped in the ring and the material that is discharged is solely the material at the respective opening. The water injection therefore at the orifice directly replaces the material exiting through the discharge opening. This injected water is indicated by the arrows 90. The exit of the heavier materials through the orifice is indicated by the arrow 91. This counter movement and replacement of the exiting material by the injected water forms a fluidized bed of the water and materials to be separated within the groove as indicated at 92. This fluidized bed allows the heavier materials to move downwardly in the groove toward the base of the groove as indicated by the arrows 93. At same time the lighter materials tend to float across the top of the fluidized bed and are expelled over the apex 89 to be discharged from the open mouth of the bowl as indicated by the arrows 94.

While not shown in the cross section of FIG. 4, the fluidized bed in view of the injection of the water through the inlet jets allows the material to remain fluidized around the whole annular extent of each ring so that the material can rotate angularly relative to the surface of the bowl so that all of the material in the ring moves past each outlet orifice in turn. The heavier materials which have by that time moved to the base of the groove are thus expelled through the outlet orifice while the lighter materials float across the top of the fluidized bed and escape to the mouth of the bowl.

The size of the orifice is thus, as explained above, relatively small. The size of the orifice is therefore governed more by the size of the particles within the bowl rather than by a requirement to adjust the discharge flow rate. In order to reduce the discharge flow rate, therefore, it is not possible simply to reduce the orifice size since the orifice size must be sufficiently large to accommodate the particles. In practice, therefore, the particles must be filtered to a size for example 30 mesh which ensures that all particle sizes are sufficiently small to pass through the orifice of the size set forth above.

In many cases it is not possible to restrict the transverse dimension of the orifice member 86 sufficiently to control the outflow of the heavier materials to a required proportion without so restricting the size of the orifice member that it can plug with particles. Even when screened to a required particle dimension, the incoming intermixed material often have larger particles. The orifice therefore cannot be smaller than the expected largest particles since otherwise the orifice will become plugged to reduce the sufficiency of operation of the device.

In order to control the flow of the heavier materials from the recess through the orifice there is provided on each outlet member 40 a valve member 50. The valve member is of the type known as a "pinch valve" which includes a valve body 51 within which there is provided a chamber 52 adjacent to an annular pinching valve sleeve 53. The valve sleeve is pinched by the injection of fluid into the chamber 52 from a supply conduit 54. The pinch valve is of a type that is well known for many different fluid control purposes and hence is not described in detail. The pinch valve is attached to the end of the duct 71 by way of a threaded coupling 55.

Each outlet member 40 is controlled by operation of a respective of the pinch valves to discharge the material intermittently. Fluid pressure is supplied to each of the control conduits 54 from a central source, the conduits being connected to a common connector at the hub of the bowl for control from a common fluid source. The details of the fluid coupling at the hub of the bowl are not shown as they will be well known to one skilled in the art.

The interior surface of the duct 71 is tapered gradually outwardly from the transverse dimension of the orifice member 86 to a wider transverse dimension 56 at the interior of the pinched valve. As shown the taper is gradually outwardly but in other arrangement the taper might occur in steps. However, the end result is that the smallest diameter of the outlet duct system is provided at the orifice 87 and from that point the outlet duct increases in diameter.

Between the pinch valve 50 and the orifice 87 is thus provided a chamber for receiving the heavier materials separated from intermixed materials and travelling in the fluidized bed within the recess.

When the valve member 50 is thus closed, the heavier materials collect within the chamber until the chamber is filled. The chamber is filled preferentially with the heavier materials in view of the fact that the heavier materials are already located preferentially at the base of the recess and in view of the fact that the centrifugal action further separates the heaviest of the heavier materials into the chamber. When filled, at a required time period as selected by the control system, the pinch valve is pulsed open to release the materials collected within the chamber. In view of the high centrifugal forces, the materials collected in the chamber form a relatively dry slug of material which is thus released by the outward divergence of the walls of the chamber so the plug exits from the chamber releasing the chamber for accumulation of further materials. The pinch valve is then pulsed closed to halt the outflow of the material. The time periods for the opening and closing of the valves are selected in accordance with the requirement for the proportion of heavier materials to be ejected and this can be monitored and controlled by a computer control system monitoring the outlet materials of the concentrate and the discharge. The operation of the valve can be controlled to change both the proportion of time in which the valve is open and also the rate at which the opening and closing is switched. In some cases, therefore, the opening and closing may be switched so rapidly that the chamber is not wholly discharged during the open time period. Only a portion of the collected slug of material is thus discharged during the open period.

Figure 5:
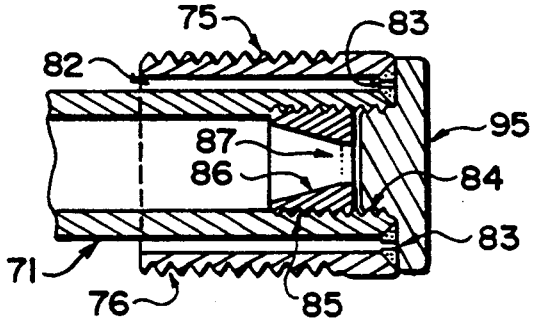
FIG. 5 is a cross sectional view similar to that of FIG. 3 showing a plugged discharge opening.

In FIG. 5 there is shown the end portion of the discharge member 40 in which the discharge orifice is closed. In this arrangement a plug member 95 is inserted into the opening of the inner tube and is screw threaded into place in cooperation with the internal screw thread 84. At the same time as closing the discharge orifice, therefore, a head of the plug member 95 also closes the inlet jets so that the whole of the discharge member is disabled.

The depth of the groove as shown in FIG. 4 is sufficient that the amount of material between the outlet orifice and the upper part of the fluidized bed 92 is sufficient to prevent the disturbance of the fluidized bed from reaching the area where the main part of the separation occurs that is in the upper part of the fluidized bed. The use of a shallower groove of less than preferably five inches could allow some disturbance to occur.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An apparatus for separating intermixed materials of different specific gravity comprising a centrifugal bowl having a base and a peripheral wall surrounding an axis passing through the base and generally upstanding from the base to an open mouth, means mounting the bowl for rotation about the axis, means for feeding the materials into the bowl so that during rotation of the bowl the materials flow over the peripheral wall for discharge from the open mouth, first guide means for collecting the discharged materials, a plurality of inwardly projecting rings carried on the peripheral wall and extending therefrom generally towards the axis over which the materials pass so that heavier material collects between the inwardly projecting rings and lighter material passes thereover to the mouth for discharge therefrom, the plurality of rings surrounding the axis at axially spaced positions along the peripheral wall and providing between each ring and the next adjacent ring an annular recess into which the heavier material collects, each annular recess having associated therewith a plurality of angularly spaced discharge openings each extending through the peripheral wall substantially radially outwardly therefrom, each discharge opening extending over only a small part of the angular extent of the respective annular recess so as to leave a major part of the angular extent of the respective annular recess free from said discharge openings and each discharge opening being at a position aligned with the respective annular recess to allow said heavier material in the annular recess to escape therefrom through the plurality of discharge openings, second guide means for collecting said heavier material from the plurality of discharge openings, and fluidizing means for fluidizing said heavier material in the annular recesses to cause said heavier material in the annular recess to move circumferentially relative to the peripheral wall of the bowl to the discharge openings to escape from the annular recess to said second guide means.

2. The apparatus according to claim 1 wherein said fluidizing means includes a plurality of first fluid injection openings extending through the peripheral wall for injecting fluid into the annular recess at a base thereof.

3. The apparatus according to claim 2 wherein the first fluid injection openings are inclined relative to a radial line through the peripheral wall so as to tend to cause rotation of the fluid circumferentially around the peripheral wall.

4. The apparatus according to claim 2 wherein each of the annular recesses is shaped in cross section to define a substantially V-shaped groove with a flat base within which said first fluid injection openings are located.

5. The apparatus according to claim 1 wherein each of the annular recesses has a radial depth of at least five inches.

6. The apparatus according to claim 1 wherein the fluidizing means includes a plurality of associated fluid injecting openings for injecting fluid through the peripheral wall into each of the annular recesses, each associated fluid injecting opening being associated with a respective one of the discharge openings at a position adjacent the respective discharge opening and being arranged to inject fluid in a direction to enter into an area of the annular recess which area lies radially inwardly of the respective discharge opening.

7. The apparatus according to claim 6 wherein each associated fluid injecting opening is arranged at least partly surround the respective discharge opening and is arranged with a direction of injection extending generally radially inwardly toward the axis of the bowl.

8. The apparatus according to claim 1 wherein each said discharge opening is provided on an insert member fastened to the bowl and including a tubular duct portion extending radially outwardly from the bowl for carrying the material discharged through said discharge opening.

9. The apparatus according to claim 8 wherein the insert member comprises an outer sleeve, an inner tube defining said duct portion mounted within the sleeve and defining an annular channel therebetween, an outer surface of the outer sleeve having a male screw thread engaged into a female screw thread in a mounting opening in the bowl.

10. The apparatus according to claim 1 wherein each said discharge opening includes a replaceable orifice member allowing modification of an area of discharge of the discharge opening.

11. The apparatus according to claim 1 including valve means for intermittently closing and opening said discharge openings to allow intermittent release of the heavier materials through said discharge openings to control the amount of said heavier materials released from the rings, each said discharge opening including an orifice at the peripheral wall and duct means defining a chamber between said valve means and said orifice for collecting said heavier material for release, wherein the valve means in an open condition thereof has transverse dimensions greater than those of the orifice and wherein said duct means defining said chamber diverges outwardly from the orifice to the valve means to allow discharge through the valve means of a slug of the heavier material collected in the chamber.

12. An apparatus for separating intermixed materials of different specific gravity comprising a centrifugal bowl having a base and a peripheral wall surrounding an axis passing through the base and generally upstanding from the base to an open mouth, means mounting the bowl for rotation about the axis, means for feeding the materials into the bowl so that during rotation of the bowl the materials flow over the peripheral wall for discharge from the open mouth, first guide means for collecting the discharged materials, separating means on the peripheral wall over which the materials pass so that heavier material collects on the separating means and lighter material passes thereover to the mouth for discharge therefrom, a plurality of angularly spaced discharge openings each extending through the peripheral wall substantially radially outwardly therefrom, each discharge opening extending over only a small part of the angular extent of the peripheral wall so as to leave a major part of the angular extent of the peripheral wall free from said discharge openings, the openings being at a position axially aligned with the separating means to allow said heavier material on the separating means to escape therefrom through the discharge openings, second guide means for collecting the heavier material from the plurality of discharge openings, and fluidizing means for fluidizing the heavier material on the separating means including a plurality of fluid injecting means each associated with a respective one of the discharge openings for injecting fluid into the bowl through the peripheral wall at a position adjacent the respective discharge opening in a direction to enter into an area in the bowl which area lies radially inwardly of the respective discharge opening.

13. The apparatus according to claim 12 wherein each fluid injecting means comprises an injection opening at least partly surrounding the respective discharge opening.

14. The apparatus according to claim 12 wherein each said discharge opening and said fluid injecting means associated therewith are provided on an insert member fastened to the bowl and including a duct portion extending radially outwardly from the bowl for carrying the material discharged through each said discharge opening.

15. The apparatus according to claim 14 wherein the insert member comprises an outer sleeve, an inner tube defining said duct portion mounted within the sleeve and defining an annular channel therebetween forming said fluid injecting means, an outer surface of the outer sleeve having a male screw thread engaged into a female screw thread in a mounting opening in the bowl.

16. The apparatus according to claim 12 wherein each fluid injecting means includes a replaceable orifice member allowing modification of an area of discharge of the opening.

17. The apparatus according to claim 12 including a plurality of plug members each associated with a respective one of said discharge openings for closing the respective one of said discharge openings, each said plug member being arranged to close both the respective discharge opening and said fluid injecting means associated therewith.

18. The apparatus according to claim 12 including valve means for intermittently closing and opening said discharge openings to allow intermittent release of the heavier materials through said discharge openings to control the amount of said heavier materials released from the separating means, each said discharge opening including an orifice at the peripheral wall and duct means defining a chamber between said valve means and said orifice for collecting said heavier material for release, wherein the valve means in an open condition thereof has transverse dimensions greater than those of the orifice and wherein said duct means defining said chamber diverges outwardly from the orifice to the valve means to allow discharge through the valve means of a slug of the heavier material collected in the chamber.

19. An apparatus for separating intermixed materials of different specific gravity comprising a centrifugal bowl having a base and a peripheral wall surrounding an axis passing through the base and generally upstanding from the base to an open mouth, means mounting the bowl for rotation about the axis, means for feeding the materials into the bowl so that during rotation of the bowl the materials flow over the peripheral wall for discharge from the open mouth, first guide means for collecting the discharged materials, separating means on the peripheral wall over which the materials pass so that heavier material collects on the separating means and lighter material passes thereover to the mouth for discharge therefrom, a plurality of angularly spaced discharge openings each extending through the peripheral wall substantially radially outwardly therefrom, each discharge opening extending over only a small part of the angular extent of the peripheral wall so as to leave a major part of the angular extent of the peripheral wall free from said discharge openings, the openings being at a position axially aligned with the separating means to allow said heavier material on the separating means to escape therefrom through the discharge openings, second guide means for collecting the heavier material from the plurality of discharge openings, and valve means for intermittently closing and opening said discharge openings to allow intermittent release of the heavier materials through said discharge openings to control the amount of said heavier materials released from the separating means, each said discharge opening including an orifice at the peripheral wall and duct means defining a chamber between said valve means and said orifice for collecting said heavier material for release, wherein the valve means in an open condition thereof has transverse dimensions greater than those of the orifice and wherein said duct means defining said chamber diverges outwardly from the orifice to the valve means to allow discharge through the valve means of a slug of the heavier material collected in the chamber.

* * * * *